US008974258B2

(12) United States Patent
Mitose et al.

(10) Patent No.: US 8,974,258 B2
(45) Date of Patent: Mar. 10, 2015

(54) CRIMP TERMINAL, CONNECTION STRUCTURAL BODY AND CONNECTOR

(71) Applicants: Kengo Mitose, Tokyo (JP); Yasushi Kihara, Tokyo (JP); Yukihiro Kawamura, Shiga (JP)

(72) Inventors: Kengo Mitose, Tokyo (JP); Yasushi Kihara, Tokyo (JP); Yukihiro Kawamura, Shiga (JP)

(73) Assignees: Furukawa Electric Co., Ltd., Tokyo (JP); Furukawa Automotive Systems Inc., Shiga (JP)

( * ) Notice: Subject to any disclaimer, the term of this patent is extended or adjusted under 35 U.S.C. 154(b) by 180 days.

(21) Appl. No.: 13/632,801

(22) Filed: Oct. 1, 2012

(65) Prior Publication Data

US 2013/0095708 A1 Apr. 18, 2013

Related U.S. Application Data

(63) Continuation of application No. PCT/JP2011/057809, filed on Mar. 29, 2011.

(30) Foreign Application Priority Data

Mar. 30, 2010 (JP) ..... 2010-077101

(51) Int. Cl.
*H01R 4/10* (2006.01)
*H01R 4/18* (2006.01)
(Continued)

(52) U.S. Cl.
CPC ..... *H01R 4/18* (2013.01); *H01R 4/184* (2013.01); *H01R 4/70* (2013.01); *H01R 13/52* (2013.01); *H01R 43/005* (2013.01); *H01R 4/188* (2013.01); *H01R 4/62* (2013.01); *H01R 2201/26* (2013.01)
USPC ..... 439/877

(58) Field of Classification Search
CPC ..... H01R 43/005
USPC ..... 439/877, 878, 886
See application file for complete search history.

(56) References Cited

U.S. PATENT DOCUMENTS 2,735,997 A * 2/1956 Peterson ..... 439/882
5,422,438 A * 6/1995 Lamome ..... 174/84 C
(Continued)

FOREIGN PATENT DOCUMENTS

JP 56-13685 2/1981
JP 2005-339850 A 12/2005
(Continued)

OTHER PUBLICATIONS

English translation of Foreign Patent (JP 56 13685 dated Feb. 10, 1981) from the ids dated Oct. 1, 2012.*
(Continued)

*Primary Examiner* — James Harvey
(74) *Attorney, Agent, or Firm* — Osha Liang LLP

(57) ABSTRACT

A crimp terminal includes barrel pieces respectively on both of two sides in a width direction thereof. The barrel pieces are included in a pressure-bonding section for pressure-bonding an exposed part of an electric wire conductor of an insulated wire. The insulated wire includes the electric wire conductor and an insulating cover for covering an outer circumference of the electric wire conductor, and the exposed part is a part of the electric wire conductor which is exposed from a tip of the cover by a predetermined length. The barrel pieces have a length in a longitudinal direction which is longer than the length of the exposed part of the electric wire conductor. The pressure-bonding section pressure-bonds, by the barrel pieces, a continuous part from a tip of the electric wire conductor to a position rear to the tip of the cover.

10 Claims, 9 Drawing Sheets

(51) Int. Cl.

| | |
|---|---|
| ***H01R 4/70*** | (2006.01) |
| ***H01R 43/00*** | (2006.01) |
| ***H01R 4/62*** | (2006.01) |
| *H01R 13/52* | (2006.01) |

(56) References Cited

U.S. PATENT DOCUMENTS

| | | | | |
|---|---|---|---|---|
| 5,532,433 | A * | 7/1996 | Endo et al. | 174/84 C |
| 7,174,633 | B2 * | 2/2007 | Onuma | 29/854 |
| 7,828,611 | B2 * | 11/2010 | Nakamura et al. | 439/877 |
| 7,905,755 | B1 * | 3/2011 | Martauz | 439/877 |
| 8,403,690 | B2 * | 3/2013 | Sawamura | 439/203 |
| 2010/0087105 | A1 * | 4/2010 | Gump et al. | 439/879 |
| 2011/0067239 | A1 * | 3/2011 | Martauz et al. | 29/885 |
| 2013/0045644 | A1 * | 2/2013 | Aoki et al. | 439/878 |
| 2013/0095708 | A1 * | 4/2013 | Mitose et al. | 439/878 |

FOREIGN PATENT DOCUMENTS

| | | | |
|---|---|---|---|
| JP | 2010-165514 | A | 7/2010 |
| JP | 2010-205583 | A | 9/2010 |

OTHER PUBLICATIONS

International Search Report issued in PCT/JP2011/057809, mailed May 17, 2011, 2 pages.

* cited by examiner

FORWARD
REARWARD
Y
A
D
1
10
20
20a
21
21a
22
22a
22b
23a
23b
30
30a
30b
31
32
32a
32b
32a, 32
32b, 32
33
41
41a
41b
41b, 41
42
42a
42b, 42
200
201
202

X
Y
Xb
10a
20
20a
21
21a
22
22a
22b
23a
23b
30
30a
30b
31
32
32a
32b
33
34
41
41a
41b
43
200
201
201a
201aa
202
202a
1a
B

CRIMP TERMINAL, CONNECTION STRUCTURAL BODY AND CONNECTOR

TECHNICAL FIELD

The present invention relates to a crimp terminal attachable to, for example, a connector or the like for connection of a wire harness for an automobile, a connection structural body including the same, and a connector having such a connection structural body located therein.

BACKGROUND ART

Today, automobiles are equipped with various electric and electronic parts, electric circuits thereof are becoming more and more complicated. Thus, stable supply of power is indispensable. An automobile equipped with such various electric and electronic parts includes wire harnesses including insulated wires in a bundle. The wire harnesses are connected to each other by connectors to form an electric circuit.

Such a connector has a built-in crimp terminal for pressure-bonding and thus connecting an insulated wire thereto by a pressure-bonding section. A male connector and a female connector are in engagement with each other.

The electric circuit constructed by such electric connection has a problem that when moisture invades a pressure-bonded section at which the insulated wire is pressure-bonded to the crimp terminal located in the connector, a surface of the electric wire conductor included in the insulated wire is corroded and thus the conductivity thereof is decreased.

This problem is considered to occur for the following reason. There is a gap between an insulation barrel of the pressure-bonding section for pressure-bonding a tip part of a cover of the insulated wire and a wire barrel of the pressure-bonding section for pressure-bonding an exposed part of the electric wire conductor which is exposed from a tip of the cover. Therefore, the tip part of the cover is exposed.

It is considered that the invasion of the moisture can be prevented by integrally enclosing a part from the tip of the cover to the tip of the electric wire conductor by use of a crimp terminal (see Patent Document 1) including a barrel in which the wire barrel and the insulation barrel are integrated. However, recent electric circuits having a complicated structure need to have a more stable conductivity. Thus, the above-described crimp terminal is not sufficient.

Today, carbon dioxide emissions are required to be reduced, and electric automobiles and hybrid automobiles which use more wire harnesses than gasoline-fueled automobiles are used. In this situation, weight reduction of all types of vehicles including gas-fueled automobiles significantly influences improvement of fuel efficiency. Therefore, there is an attempt to reduce the weight of vehicles by using electric wires formed of aluminum (or aluminum alloy), as well as copper (or copper alloy), for wire harnesses, battery cables and the like.

When an aluminum wire formed of aluminum or an aluminum alloy is pressure-bonded to a crimp terminal formed of copper or a copper alloy, there is the following problem. If there is moisture such as dew condensation, seawater or the like at a contact part of the aluminum wire and the crimp terminal, an electrochemical reaction occurs. As a result, a phenomenon called "galvanic corrosion" occurs that aluminum or the aluminum alloy, which a metal material having a low potential, is corroded by a metal material having a high potential, such as tin plating, gold plating, copper alloy or the like, which is used as a terminal material.

Due to the galvanic corrosion, the aluminum wire pressure-bonded by the pressure-bonding section of the terminal is corroded, dissolved, or extinguished, which raises the electric resistance. As a result, a sufficient conducting function may not be provided. When such an aluminum wire is used, invasion of moisture needs to prevented with more certainty.

Patent Document 1 also describes applying an epoxy paint at the time of pressure-bonding for the purpose of improving a property of stopping moisture more certainly. However, application of a paint at the time of pressure-bonding is not preferable for mass production because additional time is needed for the step of application. It is also very difficult to apply a paint while the position and the amount of application are controlled with high precision at the time of pressure-bonding. For these reasons, the method of applying an epoxy paint at the time of pressure-bonding is not satisfactory.

CITATION LIST

Patent Literature

Patent Document 1: Japanese Laid-Open Patent Publication No. Sho 56-13685

SUMMARY OF INVENTION

Technical Problem

The present invention has an object of providing a crimp terminal, a connection structural body, and a connector which can have the moisture stop property with certainty merely by pressure-bonding performed by the pressure-bonding section.

Solution to Problem

The present invention is directed to a crimp terminal, including barrel pieces respectively on both of two sides in a width direction thereof, the barrel pieces being included in a pressure-bonding section for pressure-bonding an exposed part of an electric wire conductor of an insulated wire, wherein the insulated wire includes the electric wire conductor and an insulating cover for covering an outer circumference of the electric wire conductor, and the exposed part is a part of the electric wire conductor which is exposed from a tip of the cover by a predetermined length. The barrel pieces each have a length in a longitudinal direction which is longer than the length of the exposed part of the electric wire conductor; at least a part of a surface of the pressure-bonding section is provided with moisture stop member; and the pressure-bonding section pressure-bonds, by the barrel pieces, a continuous part from a tip of the electric wire conductor to a position rear to the tip of the cover such that the continuous part is integrally enclosed by the barrel pieces.

The pressure-bonding section may be an open barrel type pressure-bonding section including a pressure-bonding bottom surface and barrel pieces provided at both of two ends in the width direction thereof.

The surface of the pressure-bonding section may be an outer surface or an inner surface of the barrel pieces included in the pressure-bonding section, or an outer surface or an inner surface of the pressure-bonding bottom surface having the barrel pieces at both of two ends in the width direction thereof.

The moisture stop member may be formed of a resin or a rubber material. The moisture stop member may be an adhesive resin or rubber sheet directly attached to a metal plate, a resin or rubber sheet bonded to a metal plate with an adhesive, or a resin or rubber material in a non-cured fluid state which is applied to a metal plate and then cured. The resin or rubber material may be cured by heat, ultraviolet, a two-liquid system, an anaerobic system, moisture or the like.

Owing to the invention, the pressure-bonding section can provide the moisture stop property with certainty merely by pressure-bonding performed by the pressure-bonding.

This will be described in more detail. The barrel pieces each have a length in a longitudinal direction which is longer than the length of the exposed part of the electric wire conductor; at least a part of a surface of the pressure-bonding section is provided with moisture stop member; and the pressure-bonding section pressure-bonds, by the barrel pieces, a continuous part from a tip of the electric wire conductor to a position rear to the tip of the cover such that the continuous part is integrally enclosed by the barrel pieces. Therefore, the pressure-bonding can be performed in the state where the electric wire conductor or the tip of the cover, which is a border between the electric wire conductor and the cover, is not exposed from the pressure-bonding section. Since the pressure-bonding section is provided with the moisture stop member, moisture can be prevented from invading the part inside the pressure-bonding section which is integrally enclosed by the pressure-bonding section. Accordingly, the pressure-bonding section can provide the moisture stop property merely by pressure-bonding performed by the pressure-bonding with certainty.

In an embodiment of the invention, the moisture stop member may be formed to extend in the width direction at an end or in the vicinity thereof, in the longitudinal direction, of an inner surface of the pressure-bonding section.

The inner surface of the pressure-bonding section may include the pressure-bonding bottom surface and the inner surface of each of the barrel pieces. The longitudinal direction may be the longitudinal direction of the crimp terminal, namely the longitudinal direction of the insulated wire connected to the crimp terminal. The width direction may be the width direction of the crimp terminal, which is perpendicular to the longitudinal direction.

The end or the vicinity thereof in the longitudinal direction of the inner surface of the pressure-bonding section may be the front end or the vicinity thereof, or the rear end or the vicinity thereof, in the longitudinal direction of the pressure-bonding bottom surface, or the front end or the vicinity thereof, or the rear end or the vicinity thereof, in the longitudinal direction of the barrel pieces.

Owing to this, moisture can be prevented with more certainty from invading the continuous part from the tip of the electric wire conductor to the tip of the cover, which is integrally enclosed and is inside the pressure-bonding section. In more detail, the front end or the vicinity thereof, or the rear end or the vicinity thereof, of the pressure-bonding section which integrally encloses the above-described part is protected against the invasion of moisture by the moisture stop member. Therefore, moisture can be prevented with certainty from invading through the border between the pressure-bonding section and the cover or through the border between the pressure-bonding bottom surface and the barrel pieces of the pressure-bonding section.

In an embodiment of the invention, in the pressure-bonding section in a pressure-bonding state, an end of one of the barrel pieces may overlap an outer surface of an end of the other barrel piece, so that an overlap part extending in the longitudinal direction is formed.

Owing to this, in the open barrel type pressure-bonding section, moisture can be suppressed with certainty from invading through the overlap part extending in the longitudinal direction in which the barrel pieces in a pressure-bonding state overlap each other. Accordingly, moisture can be prevented with more certainty from invading the continuous part from the tip of the electric wire conductor to the tip of the cover, which is integrally enclosed and is inside the pressure-bonding section.

In an embodiment of the invention, the moisture stop member may be formed on at least one of parts facing each other at ends or in the vicinity thereof of the barrel pieces which form the overlap part.

The parts facing each other at ends or in the vicinity thereof of the barrel pieces which form the overlap part are the outer surface of one of the barrel pieces and the inner surface of the other barrel piece.

Owing to this, moisture can be prevented with certainty from invading through the overlap part extending in the longitudinal direction in which the barrel pieces in a pressure-bonding state overlap each other.

In an embodiment of the invention, in the pressure-bonding section in a pressure-bonding state, end surfaces, in the width direction, of the barrel pieces may be joined together in a face-to-face manner.

Owing to this, in the open barrel type pressure-bonding section, moisture can be suppressed from invading through the part extending in the longitudinal direction at which the end surfaces, in the width direction, of the barrel pieces are joined together in a face-to-face manner. Accordingly, moisture can be prevented with more certainty from invading the continuous part from the tip of the electric wire conductor to the tip of the cover, which is integrally enclosed and is inside the pressure-bonding section.

In an embodiment of the invention, the moisture stop member may be provided on the end surface, in the width direction, of at least one of the barrel pieces.

Owing to this, moisture can be prevented with certainty from invading through the part extending in the longitudinal direction at which the end surfaces, in the width direction, of the barrel pieces in a pressure-bonding state are joined together in a face-to-face manner.

In an embodiment of the invention, the crimp terminal may further include a serration formed in an inner surface of the pressure-bonding section. The moisture stop member may be formed of a curable resin, so that the cured resin covers the serration in the form of a thin film so as to stride over the serration.

The serration may be a groove-like serration extending in the width direction, concave serrations arranged in a lattice or in a houndstooth check, or a convex serration.

Owing to the invention, the moisture stop property can be improved while the conductivity is guaranteed. In more detail, the moisture stop member is formed of a curable resin in the inner surface of the pressure-bonding section, so that the cured resin covers the serration in the form of a thin film so as to stride over the serration. Therefore, the moisture stop property of the pressure-bonding section for pressure-bonding the electric wire conductor can be improved.

However, since the curable resin covers the inner surface of the pressure-bonding section in the form of a thin film, it is difficult to provide conductivity between the pressure-bonding section and the electric wire conductor with certainty. Nonetheless, the conductivity can be provided with certainty for the following reason. The curable resin covers the inner surface of the pressure-bonding section while striding over the serration. Therefore, the curable resin in a cured state in the serration or the vicinity thereof is delaminated by the pressure-bonding pressure applied by the pressure-bonding section on the electric wire conductor. In addition, an oxide coat of the electric wire conductor is removed by being slid against edges of the serration. As a result, metal coupling occurs between the electric wire conductor and the surface of the crimp terminal. For this reason, the conductivity can be provided with certainty.

In an embodiment of the invention, a cover pressure-bonding section for pressure-bonding the cover of the insulated wire may be coupled to the pressure-bonding section.

Owing to the invention, even if an external force such as a bending force or the like acts, moisture stop performance can be provided with certainty. For example, when a load caused by an external force such as a bending force, a tensile force or the like having a large vibration width acts on the insulated wire excessively, a gap may be formed between the pressure-bonding section and the surface of the cover. However, in the case where the cover pressure-bonding section is coupled to the pressure-bonding section, the load caused by the external force acts on the cover pressure-bonding section. Therefore, no gap is formed between the pressure-bonding and the surface of the cover. Thus, perfect moisture stop is realized.

The present invention is also directed to a connection structural body, including the insulated wire and the crimp terminal which are connected to each other by the pressure-bonding section of the above-described crimp terminal.

Owing to the invention, a connection structural body capable of providing the moisture stop property with certainty merely by pressure-bonding performed by the pressure-bonding section of the crimp terminal can be realized. Accordingly, stable conductivity is guaranteed.

In an embodiment of the invention, the insulated wire may be connected such that the tip of the electric wire conductor is located at an intermediate position, in the longitudinal direction, of the pressure-bonding section.

Owing to the invention, the continuous part from the tip of the electric wire conductor to the tip of the cover can be integrally enclosed by the pressure-bonding section, so that moisture can be prevented from invading the inside of the pressure-bonding with more certainty.

In an embodiment of the invention, the electric wire conductor of the insulated wire may be formed of an aluminum wire conductor.

The aluminum wire conductor may include aluminum wires or aluminum alloy wires.

Owing to this invention, even when, for example, the crimp terminal is formed of a copper alloy plated with tin or the like, the galvanic corrosion, by which the aluminum wire conductor formed of a metal material having a lower potential than that of the copper alloy used to form the crimp terminal is corroded, can be prevented. Accordingly, a connection state with stable conductivity can be provided with certainty regardless of the type of metal material used to form the crimp terminal and the electric wire conductor.

The present invention is also directed to a connector, including the crimp terminal in the above-described connection structural body located in a connector housing.

Owing to the invention, an engagement state with stable conductivity can be provided with certainty regardless of the type of metal material used to form the crimp terminal and the electric wire conductor.

Advantageous Effects of Invention

According to the present invention, a crimp terminal, a connection structural body, and a connector which can have the moisture stop property with certainty merely by pressure-bonding performed by the pressure-bonding section are provided.

DESCRIPTION OF EMBODIMENTS

An embodiment of the present invention will be described with reference to the drawings.

Figure 1:
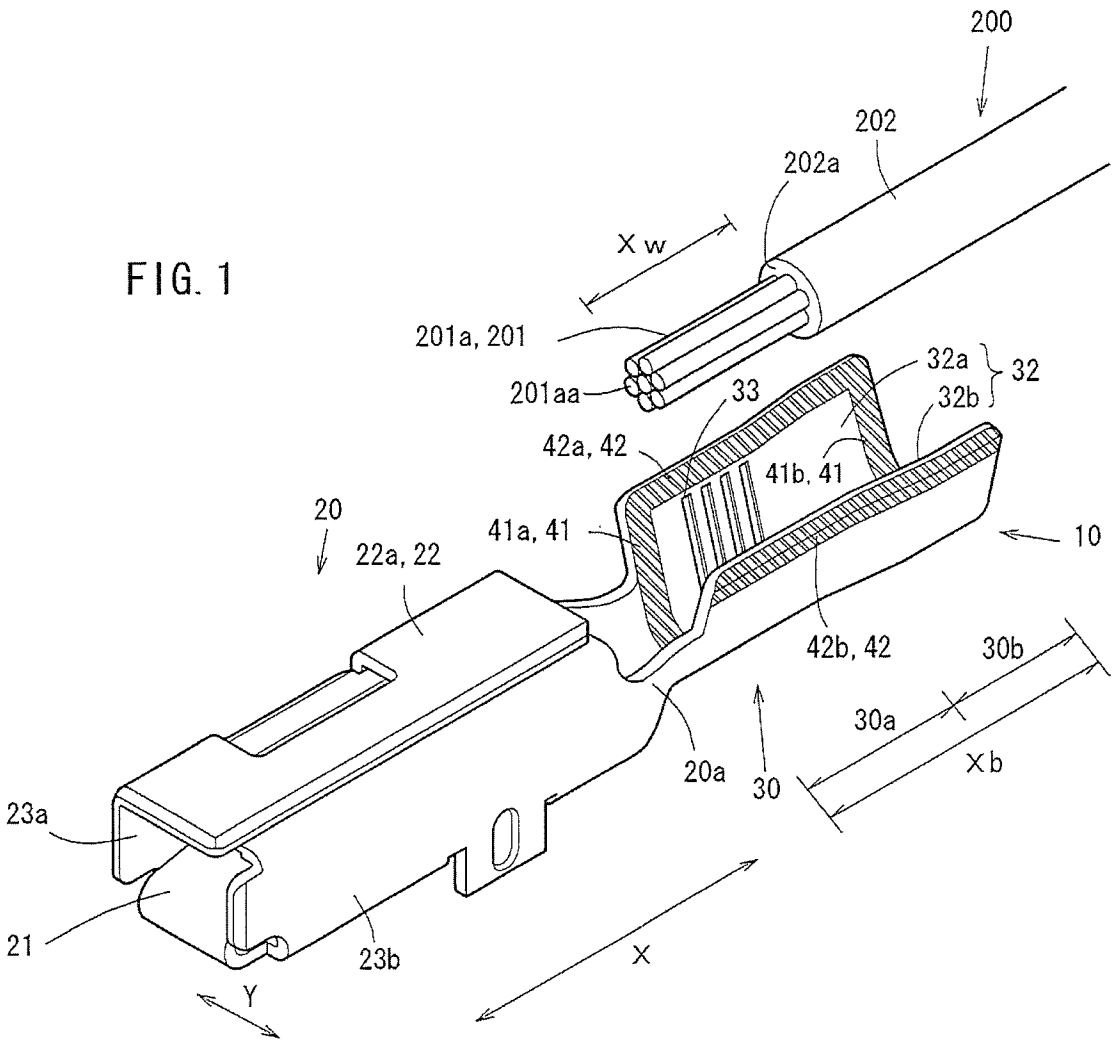
FIG. 1 is an isometric view of a crimp terminal.
Figures 2A, 2B, 2C, 2D, 2E:
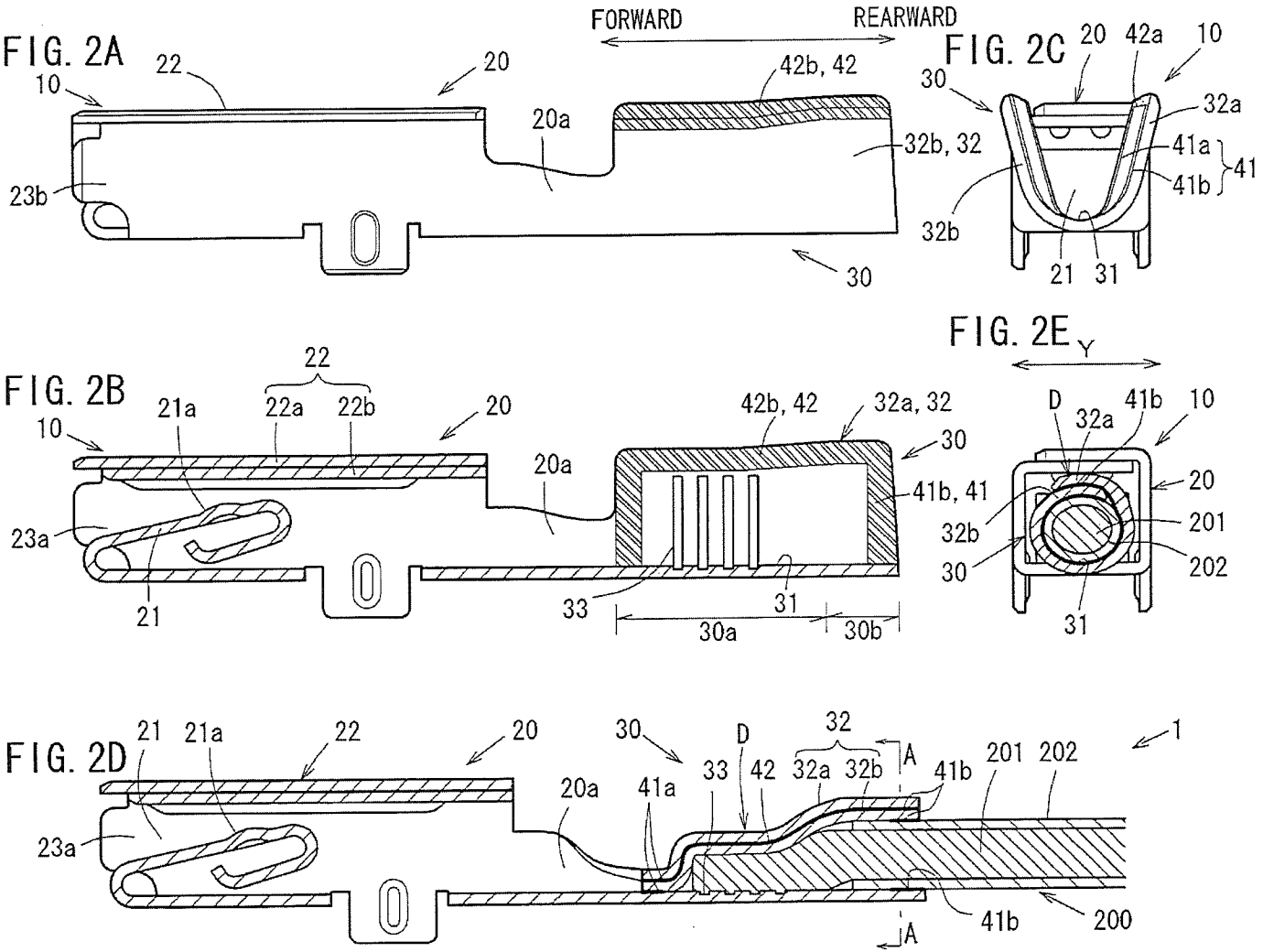
FIG. 2 illustrates the crimp terminal.

FIG. 1 is an isometric view of a female crimp terminal 10, and FIG. 2 illustrates the female crimp terminal 10. FIG. 2(*a*) is a side view of the female crimp terminal 10. FIG. 2 (*b*) is a longitudinal cross-sectional view of the female crimp terminal 10 taken along a central line in a width direction thereof. FIG. 2(*c*) is a rear view of the female crimp terminal 10. FIG. 2(*d*) is a longitudinal cross-sectional view of a pressure-bonding connection structural body 1 taken along a central line in the width direction thereof. FIG. 2(*e*) is a lateral cross-sectional view of the pressure-bonding connection structural body 1 taken along line A-A, which is in a rear part of a pressure-bonding section 30 of the pressure-bonding connection structural body 1 shown in FIG. 2(*d*).

Figure 3A:
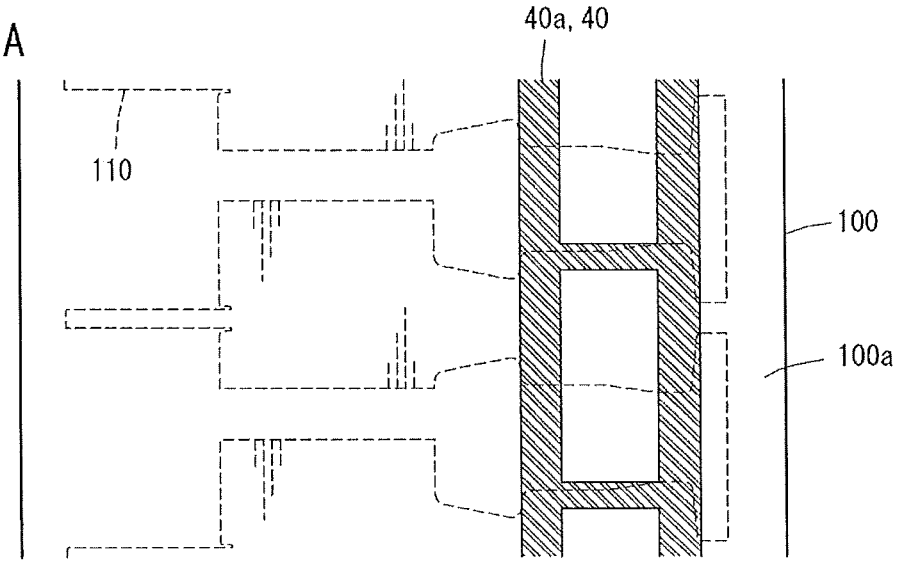
FIG. 3 illustrates a chain terminal.
Figure 3B:
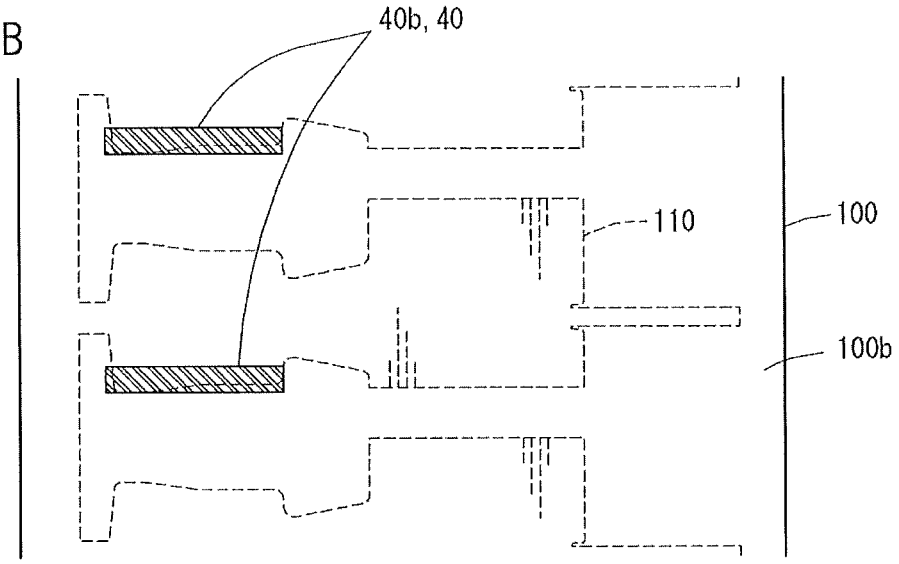

FIG. 3 illustrates a chain terminal 110 used to form the female crimp terminal 10. More specifically, FIG. 3 (*a*) is a plan view of a copper alloy strip 100 used to form the chain terminal 110 located such that an inner surface of the female crimp terminal 10 is directed upward. FIG. 3 (*b*) is a plan view of the copper alloy strip 100 used to form the chain terminal 110 located such that an outer surface of the female crimp terminal 10 is directed upward.

Figures 4A, 4B:
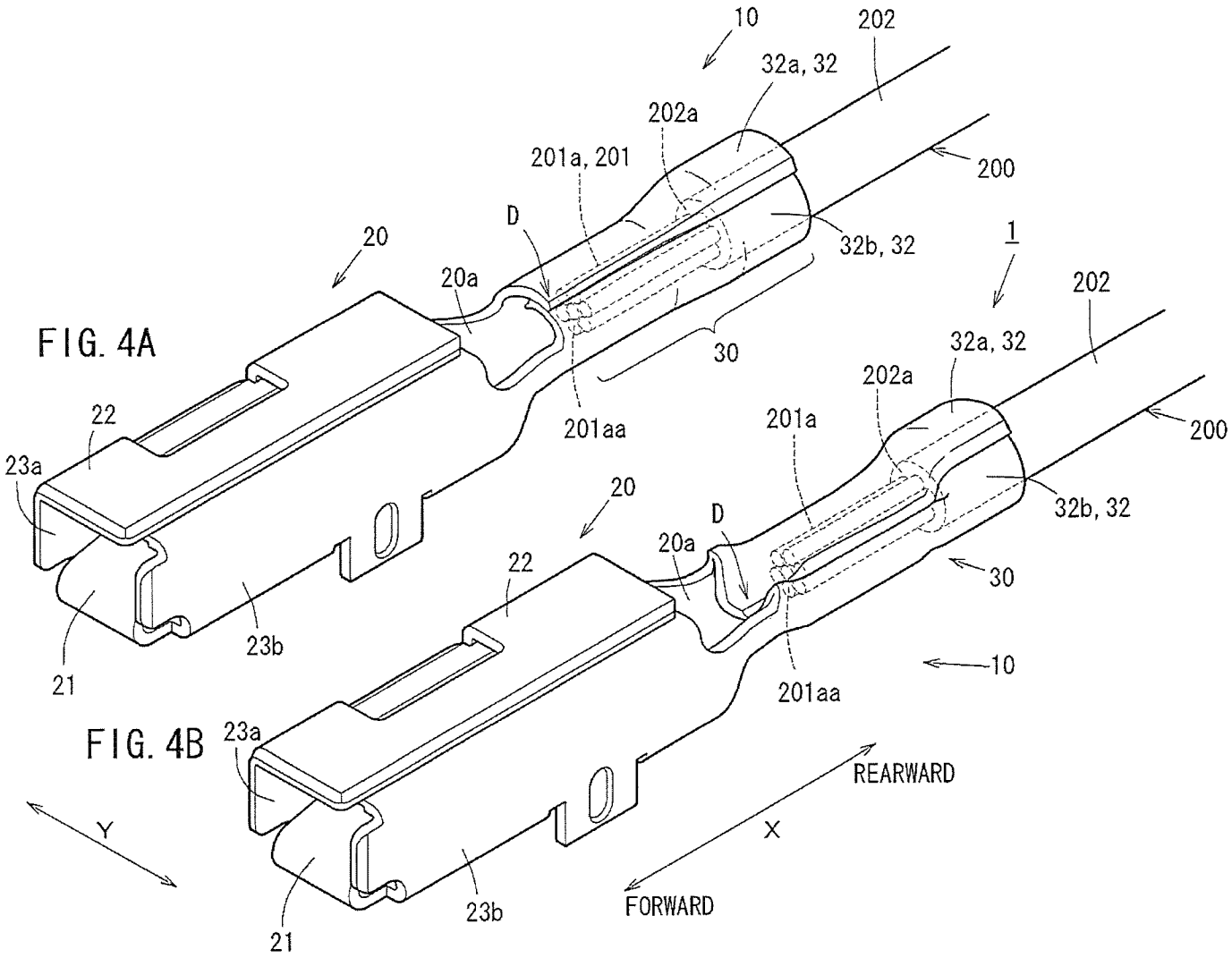
FIG. 4 illustrates pressure-bonding performed by the crimp terminal.

FIG. 4 provides isometric views of pressure-bonding performed on an insulated wire 200 by the pressure-bonding section 30 included in the pressure-bonding connection structural body 1. FIG. 4(*a*) is an isometric view thereof in a first caulking state, and FIG. 4(*b*) is an isometric view of the pressure-bonding connection structural body 1 in a final caulking state.

First, the female crimp terminal 10 will be described. The female crimp terminal 10 includes a connector box 20 for allowing an insertion tab of a male connector (not shown) to be inserted thereinto, and the pressure-bonding section 30, which are integrated with each other. The connector box 20 is located at a front side in a longitudinal direction X, and the pressure-bonding section 30 is located rear to the connection box 20, and a transition section 20*a* having a predetermined length is located between the connector box 20 and the pressure-bonding section 30. The longitudinal direction X is a direction matching a longitudinal direction of the insulated wire 200 to be pressure-bonded by the connector box 20 and thus connected to the female crimp terminal 10.

The insulated wire 200 to be connected to the crimp terminal 10 by pressure-bonding includes an aluminum core wire 201, which is a bundle of aluminum wires, and an insulating cover 202 for covering the aluminum core wire 201. The insulating cover 202 is formed of an insulating resin.

The female crimp terminal 10 is an open barrel type terminal formed to be three-dimensional by punching and bending a copper alloy strip, for example, a brass strip, having a tin-plated (Sn-plated) surface.

A pressure-bonding section of a male crimp terminal having the insertion tab to be inserted into the connection box 20 has substantially the same structure.

The connector box 20 has a shape of hollow quadrangular prism provided in an inverted state. The connector box 20 accommodates an elastic contact piece 21 therein. The elastic contact piece 21 has a dimple 21*a* which is bent rearward in the longitudinal direction X and is contactable with the insertion tab of the male connector (not shown) when the male connector is inserted.

Ceiling parts 22 (22*a*, 22*b*) of the connector box 20 having the shape of hollow quadrangular prism are parts extended from side parts 23 (23*a*, 23*b*) and bent to overlap each other.

As shown in FIG. 2(*b*), the pressure-bonding section 30 in a pre-pressure-bonding state includes barrel pieces 32 (32*a*, 32*b*). The barrel pieces 32 (32*a*, 32*b*) extend from both of two sides in the width direction Y of a pressure-bonding bottom surface 31 in obliquely outward and upward directions, and are generally rectangular when seen in a side view. The barrel pieces 32 (32*a*, 32*b*) are generally U-shaped when seen in a rear view.

Length Xb (see FIG. 1) of the barrel pieces 32 in the longitudinal direction is longer than exposure length Xw in the longitudinal direction X of an electric wire exposed part 201*a*. The electric wire exposed part 201*a* is exposed forward in the longitudinal direction X from a cover tip 202*a*, which is a front tip of the insulating cover 202 in the longitudinal direction X.

In more detail, the pressure-bonding section 30 includes an electric wire pressure-bonding range 30*a* for pressure-bonding the electric wire exposed part 201*a* and a cover pressure-bonding range 30*b* for pressure-bonding the insulating cover 202, which are integrated with each other. The electric wire pressure-bonding range 30*a* and the cover pressure-bonding range 30*b* respectively have shapes conformed to outer diameters of the aluminum core wire 201 and the insulating cover 202 to be pressure-bonded. Therefore, the barrel pieces 32 have a longer inner circumferential length in the cover pressure-bonding range 30*b* for pressure-bonding the insulating cover 202 than in the electric wire pressure-bonding 30*a* for pressure-bonding the aluminum core wire 201.

In an inner surface of the electric pressure-bonding range 30*a*, four serrations 33 are formed in parallel in the longitudinal direction X. The serrations 33 are grooves extending in the width direction Y into which the aluminum core wire 201 eats in the state where the aluminum core wire 201 is pressure-bonded. The serrations 33 extend from the pressure-bonding bottom surface 31 in obliquely outward and upward directions from both of two sides of the pressure-bonding bottom surface 31 in the width direction Y; namely, the serrations 33 are continuous from an upper position of one of the barrel pieces 32 to an upper position of the other barrel piece 32 through the pressure-bonding bottom surface 31.

The pressure-bonding section 30 includes belt-like width direction seals 41 (41*a*, 41*b*) extending in the width direction Y, and belt-like longitudinal direction seals 42 (42*a*, 42*b*) extending in the longitudinal direction X. The width direction seals 41 are provided at a front end and a rear end in the longitudinal direction X of the pressure-bonding section 30. The longitudinal direction seals 42*a* are provided at an end in the width direction Y of the inner surface of the left barrel piece 32*a* and at an end in the width direction Y of the outer surface of the right barrel piece 32*b*.

The rear width direction seal 41*b* to be in close contact with an outer circumferential surface of the insulating cover 202 to provide the moisture stop property with certainty is preferably formed of a material having rubber properties. Among such materials, silicone rubber, fluorine rubber, butyl rubber, butadiene rubber, ethylenepropyl rubber, nitrile rubber or the like has been found to be suitable from the viewpoints of alkali resistance and thermal resistance as a result of accumulated studies.

It is more preferable that the rear width direction seal 41*b* is formed of a material which is not hard and is elastic. From the viewpoint of ease of pressure-bonding by the pressure-bonding section 30 and ease of provision on the copper alloy strip 100 described later, it is preferable that the thickness of the rear width direction seal 41*b* is approximately equal to the thickness of the copper alloy strip 100 (FIG. 3) used to form the female crimp terminal 10 in the state before pressure-bonding is performed by the pressure-bonding section 30. Preferably, the thickness of the rear width direction seal 41*b* is ⅓ or greater and three times or less of the thickness of the copper alloy strip 100. In each of the figures, the female crimp terminal 10 is shown thicker than actual, and the width direction seals 41 and the longitudinal direction seals 42 are shown thinner than actual, for the sake of convenience.

In the meantime, the front width direction seal 41*a* provided on the front side of the pressure-bonding section 30 is preferably formed of a resin or a rubber material which is highly hard and is not deformed much even when being pressed by the barrel pieces. It is not preferable that a seal formed of a resin or a rubber material which is not hard is provided in an excessively large amount. A reason for this is that when the barrel pieces 32 are pressed onto the pressure-bonding bottom surface 31, an extra amount of the seal flows toward the connector box 20, which requires an additional step of removing this. If not removed, the extra amount of the seal material which has flown comes off during use and is attached to a terminal contact, and thus may desirably cause a contact disorder.

Therefore, in the case where the front width direction seal 41*a* is formed of a resin or a rubber material which is not hard, such a material needs to be used in an appropriate amount. In this case, the thickness of the front width direction seal 41*a* may be appropriately selected in the range from 5 μm to the thickness of the copper alloy strip 100 in the state before pressure-bonding is performed by the pressure-bonding section 30. Preferably, the thickness of the front width direction seal 41*a* is 10 to 100 μm.

As described later, the longitudinal direction seals 42 (42*a*, 42*b*) are formed in an overlap part D where the barrel pieces 32 contact each other. Therefore, the longitudinal direction seals 42 (42*a*, 42*b*) are formed of the same material as that of the front width direction seal 41*a*.

As shown in FIG. 3, the female crimp terminal 10 having such a structure is formed of the copper alloy strip 100 having a predetermined width. The copper alloy strip 100 is provided with moisture stop seals 40 (40*a*, 40*b*) which are to act as the width direction seals 41 and the longitudinal direction seals 42 (FIG. 1, FIG. 2). The moisture stop seals 40 (40*a*, 40*b*) are respectively provided on a front surface and a rear surface of the copper alloy strip 100. The copper alloy strip 100 is punched into a shape of the terminal to form the chain terminal 100. Then, the chain terminal 100 is bent to form the female crimp terminal 10.

This will be described in more detail. In the reflow tin-plated copper alloy strip 100, a surface 100*a* which is to form the inner surface of the female crimp terminal 10 is provided with the moisture stop seal 40*a* at positions corresponding to the width direction seals 41 and the inner longitudinal direction seal 42*a*. A surface 100*b* which is to form the outer surface of the female crimp terminal 10 is provided with the moisture stop seal 40*b* at a position corresponding to the outer longitudinal direction seal 42*b*.

The copper alloy strip 100 having the moisture stop seals 40 formed thereon is punched into the chain terminal 110, and the chain terminal 110 is bent to form the female crimp terminal 10. The insulated wire 200 is pressure-bonded to the pressure-bonding section 30 to form the pressure-bonding connection structural body 1 (FIG. 1, FIG. 2). In more detail, the insulated wire 200 is located on the pressure-bonding section 30 such that a tip 201*aa* of the electric wire exposed part 201*a* of the aluminum core wire 201 is located rear to the front width direction seal 41*a* of the pressure-bonding section 30 in the longitudinal direction X. The electric wire exposed part 20 is a tip part of the aluminum core wire 201 which is exposed from the insulating cover 202 of the insulated wire 200.

As shown in FIG. 4(*a*), a part from the tip 201*aa* of the electric wire exposed part 201*a* to a position rear to the cover tip 202*a* of the insulating cover 202 is once pressure-bonded by the pressure-bonding section 30 and integrally enclosed in the pressure-bonding section 30.

For this pressure-bonding, the barrel pieces 32 are wound around the electric wire exposed part 201*a* of the aluminum core wire 201 and the insulating cover 202, such that the end in the width direction Y of the left barrel piece 32*a* overlaps the end in the width direction Y of the right barrel piece 32*b* to form the overlap part D by use of a first crimper (not shown).

The pressure-bonding by the barrel pieces 32 is strengthened by using a second crimper (not shown) to connect the female crimp terminal 10 and the insulated wire 200 by the pressure-bonding section 30, such that the front ends of the barrel pieces 32 are in close contact with the pressure-bonding bottom surface 31 with the front width direction seal 41*a* held therebetween, such that the electric wire pressure-bonding range 30*a* is in close contact with the electric wire exposed part 20*a*, and such that the cover pressure-bonding range 30*b* is in close contact with the cover tip 202*a* and also an outer circumferential surface of the insulating cover 202 with the rear width direction seal 41*b* held therebetween. Thus, the pressure-bonding connection structural body 1 is formed.

In this state, the front ends of the barrel pieces 32 are in close contact with the pressure-bonding bottom surface 31 with the front width direction seal 41*a* held therebetween. Therefore, the moisture stop property can be provided with certainty by the front width direction seal 41*a* at the front side of the pressure-bonding 30.

As shown in FIG. 2(*e*), the overlap part D is formed such that the end in the width direction Y of the left barrel piece 32*a* overlaps the end in the width direction Y of the right barrel piece 32*b*. Therefore, the inner longitudinal direction seal 42*a* formed on the inner surface of the end in the width direction Y of the left barrel piece 32*a* is in close contact with the outer longitudinal direction seal 42*b* formed on the outer surface of the end in the width direction Y of the right barrel piece 32*b*. Thus, the moisture stop property can be provided with certainty at the overlap part ID extending in the longitudinal direction of the pressure-bonding 30.

As shown in FIG. 2(*d*) and FIG. 2(*e*), the cover pressure-bonding range 30*b* is in close contact with the outer circumferential surface of the insulating cover 202 via the rear width direction seal 41*b* held therebetween. Therefore, the moisture stop property can be provided with certainty by the rear width direction seal 41*b* at the rear end of the pressure-bonding 30.

Accordingly, in the pressure-bonding connection structural body 1 having such a structure, neither the electric wire exposed part 201*a* nor the cover tip 202*a* is exposed from the pressure-bonding section 30, and thus moisture invasion to the aluminum core wire 201 and to the inside of the insulating cover 202 in the pressure-bonding section 30 can be prevented. Therefore, a surface of the aluminum core wire 201 is prevented from being corroded, and conductivity between the female crimp terminal 10 and the aluminum core wire 201 is prevented from decreasing.

The aluminum core wire 201 is formed of aluminum, which has a lower potential than that of the copper alloy strip 100 used to form the female crimp terminal 10. Therefore, galvanic corrosion, which is caused by moisture attaching a contact part of the female crimp terminal 10 and the aluminum core wire 201, can be prevented. Accordingly, the pressure-bonding connection structural body 1 has a connection state having a stable conductivity between the female crimp terminal 10 and the aluminum core wire 201, with certainty.

In the above description, the electric wire conductor and the aluminum core wire 201 are used. Alternatively, a copper alloy core wire formed of general copper alloy wires may be used.

The ends in the width direction of both of the left barrel piece 32*a* and the right barrel piece 32*b*, which form the overlap part D, are respectively provided with the inner longitudinal direction seal 42*a* and the outer longitudinal direction seal 42*b*. It is sufficient that at least one of the inner longitudinal direction seal 42*a* and the outer longitudinal direction seal 42*b* is provided.

Figures 5A, 5B:
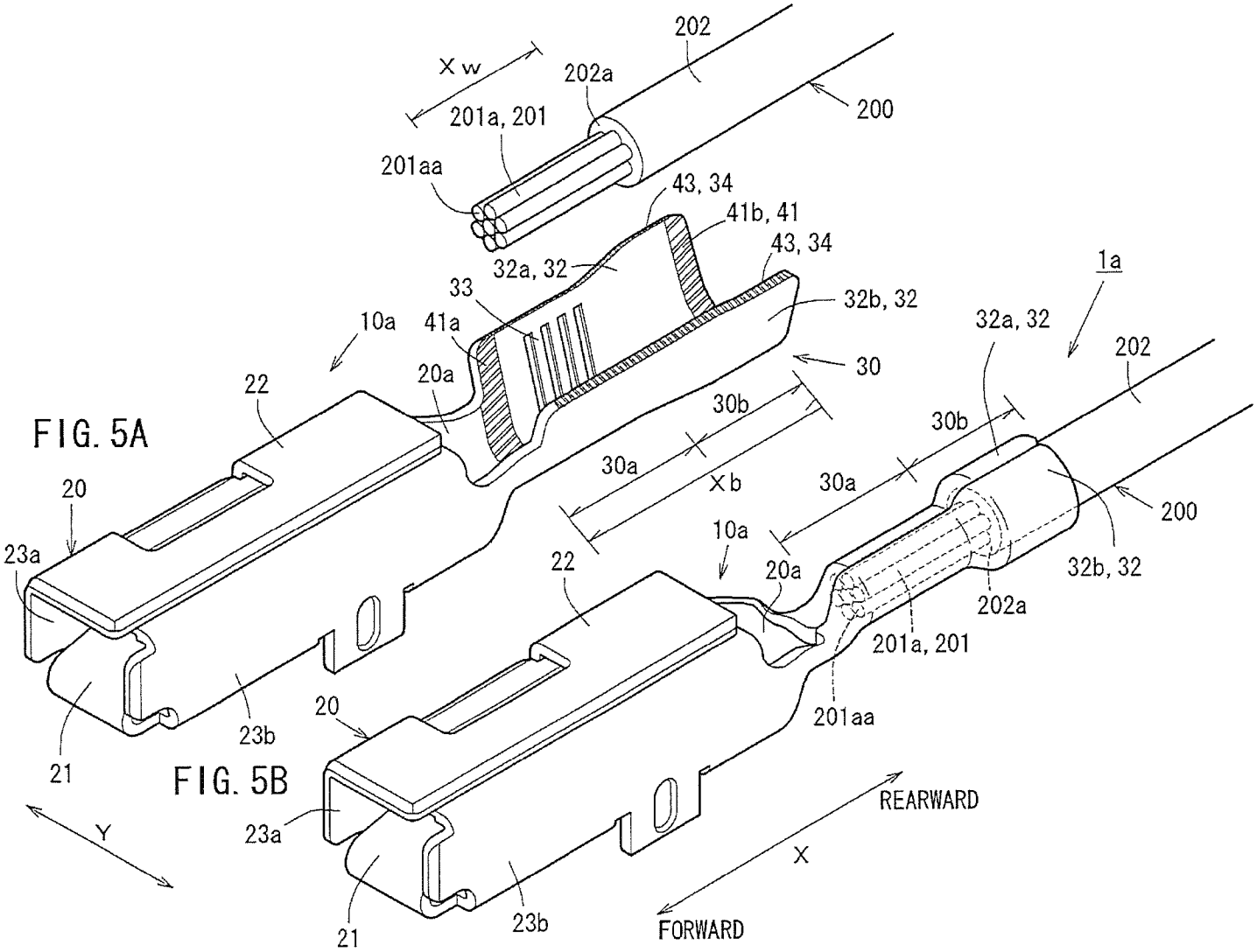
FIG. 5 is an isometric view of a crimp terminal in a second pattern.

Now, a female crimp terminal 10*a* in a second pattern will be described. As shown in FIG. 5(*a*) and FIG. 6, in the female crimp terminal 10*a* in the second pattern, a total length of the barrel pieces 32 of the pressure-bonding section 30 is approximately equal to an outer circumferential length of the electric wire exposed part 201*a* or the outer circumferential length of the insulating cover 202. The barrel pieces 32 are provided with side end surface seals 43 on side end surfaces 34 in the width direction Y, in addition to the width direction seals 41 provided in the female crimp terminal 10 described above. The side end surface seals 43 are formed of the same material as that of the front width direction seal 41*a*.

Figures 6A, 6B, 6C, 6D, 6E:
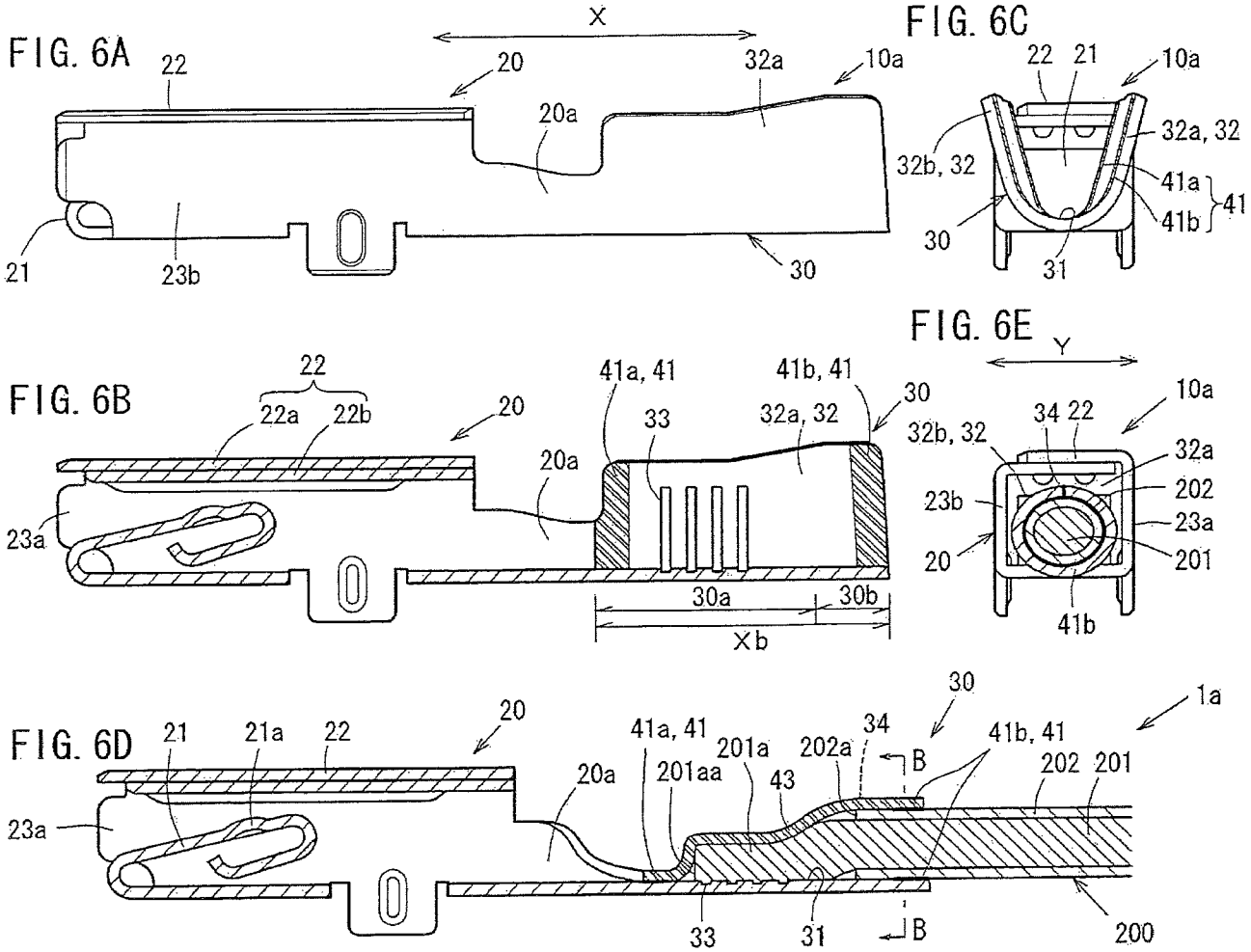
FIG. 6 illustrates the crimp terminal in the second pattern.

FIG. 5(*a*) is an isometric view of the female crimp terminal 10*a* in the second pattern, and FIG. 5(*b*) is an isometric view of a pressure-bonding connection structural body la formed by caulking the electric wire exposed part 201*a* by the pressure-bonding section 30. FIG. 6 illustrates the female crimp terminal 10*a* in the second pattern. FIG. 6(*a*) is a side view of the female crimp terminal 10*a*. FIG. 6(*b*) is a longitudinal cross-sectional view of the female crimp terminal 10*a* taken along a central line in a width direction thereof. FIG. 6(*c*) is a rear view of the female crimp terminal 10*a*. FIG. 6(*d*) is a longitudinal cross-sectional view of the pressure-bonding connection structural body 1*a* taken along a central line in the width direction thereof. FIG. 6(*e*) is a lateral cross-sectional view of the pressure-bonding connection structural body 1*a* taken along line B-B, which is in a rear part of the pressure-bonding section 30 of the pressure-bonding connection structural body 1*a* shown in FIG. 6(*d*).

As described above with respect to FIG. 3, the female crimp terminal 10*a* having such a structure is formed as follows. A copper alloy strip 100 having a predetermined width provided with moisture stop seals 40 on a front surface thereof is punched into the shape of the terminal to form a chain terminal 110. The chain terminal 110 is bent and cut to form the female crimp terminal 10*a*.

As described above, the copper alloy strip 100 provided with the moisture stop seals 40 is punched into the shape of the terminal to form the chain terminal 110. The chain terminal 110 is bent to form the female crimp terminal 10*a*. The insulated wire 200 is located on the pressure-bonding section 30 such that the tip 201*aa* of the electric wire exposed part 201*a* is located rear to the front width direction seal 41*a* of the pressure-bonding section 30 in the longitudinal direction X. The insulated wire 200 is pressure-bonded by the pressure-bonding section 30 to form the pressure-bonding connection structural body 1*a*.

At this point, the side end surface 34 of the left barrel piece 32*a* and the side end surface 34 of the right barrel piece 32*b* (FIG. 5) are pressure-bonded with each other by use of a crimper (not shown) in a face-to-face manner, right above the electric wire exposed part 201*a* and the insulating cover 202.

In this state, the front ends of the barrel pieces 32 are in close contact with the pressure-bonding bottom surface 31 with the front width direction seal 41*a* held therebetween. Therefore, the moisture stop property can be provided with certainty by the front width direction seal 41*a* at the front side of the pressure-bonding 30. As shown in FIG. 6(*e*), the side end surface 34 of the left barrel piece 32*a* and the side end surface 34 of the right barrel piece 32*b* are in close contact with each other in a face-to-face manner. Therefore, the moisture stop property in the longitudinal direction of the pressure-bonding 30 can be provided with certainty by the side end surface seals 43.

As shown in FIG. 6(*d*) and FIG. 6(*e*), the cover pressure-bonding range 30*b* is in close contact with the outer circumferential surface of the insulating cover 202 via the rear width direction seal 41*b* held therebetween. Therefore, the moisture stop property can be provided with certainty by the rear width direction seal 41*b* at the rear end of the pressure-bonding 30.

Accordingly, the pressure-bonding connection structural body in formed by use of the female crimp terminal in provides substantially the same moisture stop effect as that of the pressure-bonding connection structural body 1 using the above-described female crimp terminal 1.

In the above description, both of the left barrel piece 32*a* and the right barrel piece 32*b* are each provided with the side end surface seal 43. Alternatively, the side end surface seal 43 may be provided on either one of the left barrel piece 32*a* and the right barrel piece 32*b*.

In a female crimp terminal 10 in another pattern, an outer surface of the pressure-bonding section 30 may be provided with a moisture stop seal such that an area in the longitudinal direction X between the front width direction seal 41*a* and the rear width direction seal 41*b* is wrapped, in addition to the width direction seals 41.

The length, width, shape, thickness or the like of the width direction seals 41, the longitudinal direction seals 42 or the moisture stop seal provided on the outer surface of the pressure-bonding section 30 may be appropriately set in accordance with the diameter or the material of the female crimp terminal 10 and the insulated wire 200. The material of the width direction seals 41, the longitudinal direction seals 42, the side end surface seals 43 or the moisture stop seal provided on the outer surface of the pressure-bonding section 30 may also be appropriately set in accordance with the diameter or the material of the female crimp terminal 10 and the insulated wire 200.

The pressure-bonding connection structural body 1 (1*a*) using such a crimp terminal 10 (10*a*) is mounted on a connector housing 300, so that connectors 3 (3*a*, 3*b*) having conductivity with certainty can be formed. In the following description, both of the connectors 3 (3*a*, 3*b*) are connectors of a wire harness. Alternatively, one of the connectors may be a connector of the wire harness, and the other connector may be a connector of an assisting part such as substrates, components or the like.

Figure 7:
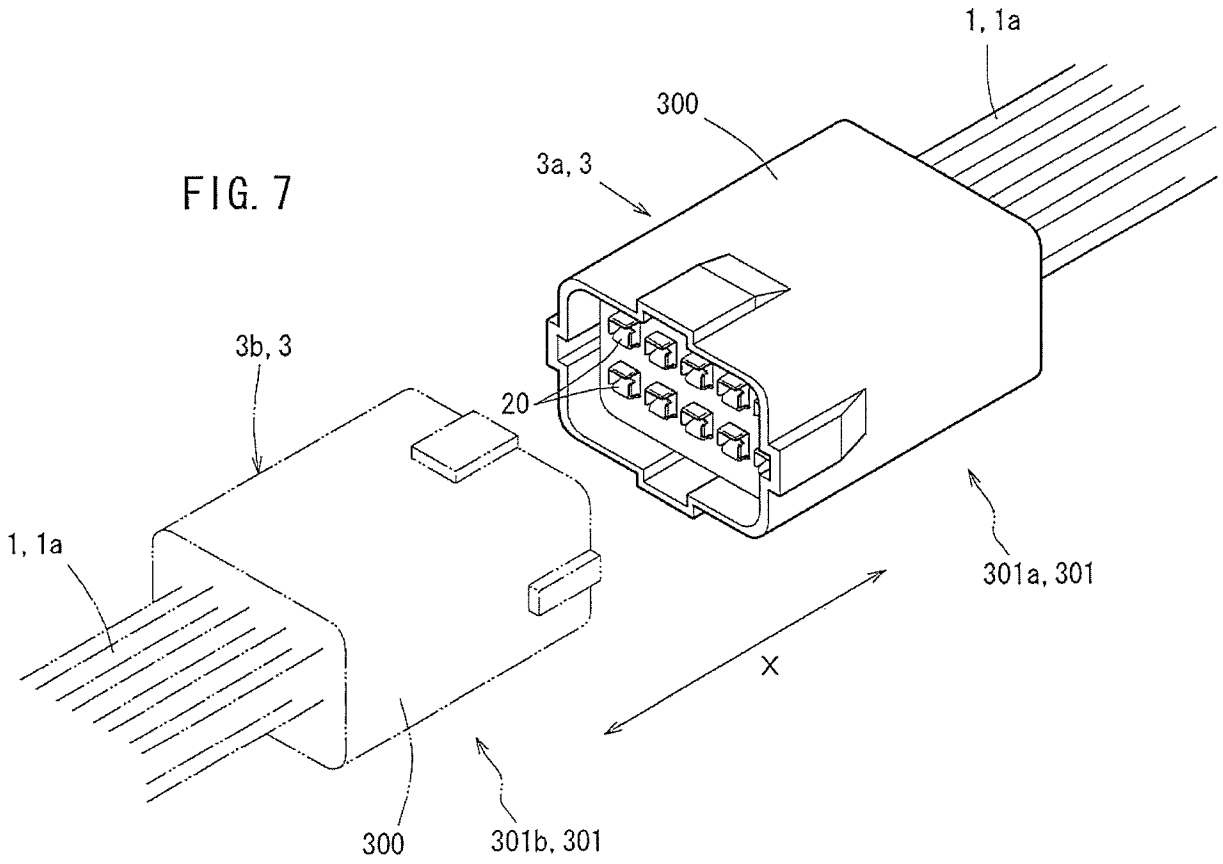
FIG. 7 is an isometric view of a connector.

This will be described in more detail. FIG. 7 is an isometric view of the connectors 3 each having the pressure-bonding connection structural body 1 (1*a*) mounted thereon. As shown in FIG. 7, the pressure-bonding connection structural body 1 (1*a*) including the crimp terminal 10 (10*a*) is mounted on a female connector housing 300 to form a wire harness 301*a* including the female connector 3*a*. Another pressure-bonding connection structural body 1 (1*a*) including a male crimp terminal (not shown) is mounted on a male connector housing 300 to form a wire harness 301*b* including the male connector 3*b*. The female connector 3*a* and the male connector 3*b* are engaged to each other to connect the wire harness 301*a* and the wire harness 301*b* to each other.

At this point, the pressure-bonding connection structural body 1 (1*a*) including the crimp terminal 10 (10*a*) and the insulated wire 200 connected to each other is mounted on each of the connector housings 300. Therefore, the wire harnesses 301 (301*a*, 301*b*) have conductivity with certainty.

The crimp terminal 10 (10*a*) is inserted into the connector housing 300. The gap between the crimp terminal 10 (10*a*) and an inner wall of the connector housing 300 is a very small space, and an aqueous solution of electrolyte such as salt water or the like corrodes tin plating on the surface of the crimp terminal 10 (10*a*). In addition, it has been found that the narrowness of the gap, together with other factors, makes the solution strongly alkaline.

However, the aluminum core wire 201 is integrally enclosed by the pressure-bonding section 30 and is not exposed. Therefore, even though the inside of the connector 300 is exposed to an alkaline solution, the electric connection between the aluminum core wire 201 and the crimp terminal 10 (10*a*) inside the pressure-bonding section 30 can be maintained. Thus, the conductivity can be maintained with certainty.

A corrosion test was performed on the female connector 3*a* and the male connector 3*b* having such a structure and engaged with each other. The corrosion test will be described, hereinafter. In this corrosion test, deterioration of the connection resistance, and corrosion and deterioration of the aluminum conductor, were evaluated in order to find the state of conductivity.

First, for performing the corrosion test, a reflow tin-plated copper alloy strip having a thickness of 0.2 mm (FAS680H, produced by Furukawa Electric Co., Ltd.) was used as the copper alloy strip 100. The copper alloy strip 100 was punched into the shape of the terminal to form the chain terminal 110. Then, as shown in FIG. 3, moisture stop seals 40 formed of various types of resins and rubber materials were provided on the chain terminal 110. The chain terminal 110 was bent to form a male crimp terminal 10 (10*a*) having a 0.64 mm-wide tab and a female crimp terminal 10 (10*a*).

The resin materials and the rubber materials provided on the chain terminal 110 were as follows. For butyl rubber, silicone rubber, and urethane rubber, commercially available sheets of such materials were used and were pressed to be reduced in the thickness when necessary. Then, the sheets were pasted on the chain terminal 110.

For epoxy-based UV-curable resin and urethane-based UV-curable resin, 3052C produced by ThreeBond Co., Ltd. and U426B produced by Chemitech Inc. were respectively used. The materials were applied by use of a coater and cured by irradiation with ultraviolet.

Next, an aluminum core wire 201 formed of aluminum wires (composition of the aluminum wires: ECAI, 11 wires being twisted) having a conductor cross-sectional area size of 0.75 $mm^2$ and a length of 11 cm was pressure-bonded and thus attached to the pressure-bonding section 30 of the produced crimp terminal 10 (10*a*) to form the pressure-bonding connection structural body 1 (1*a*). An end of the insulated wire 200 opposite to the end pressure-bonded to the pressure-bonding section 30 of the crimp terminal 10 (10*a*) was stripped of the insulating cover 202 by a length of 10 mm and immersed in a solder bath for aluminum (produced by Nihon Almit Co., Ltd.; T235, using flux). Thus, the surface of the opposite end of the aluminum core wire 201 was soldered. This decreases the resistance of the contact point with the probe at the time of measurement of the electric resistance to a minimum possible level.

The initial resistance measurement and the corrosion test were performed on 20 samples for each standard, i.e., 10 male terminals and 10 female terminals. The resistance increasing value and the corrosion state were measured and observed on all of the samples.

The initial resistance was measured by use of a resistance meter (ACmQHiTESTER3560; produced by Hioki E.E. Corporation) by a 4-terminal method. An inner surface of the side parts 23 of the connector box 20 was set as a positive electrode, and the end of the aluminum core wire 201 of the insulated wire 200 which is opposite to the end connected to the crimp terminal 10 (10*a*) was set as a negative electrode. The measured resistance value was considered to be a total sum of the resistances of the aluminum core wire 201, of the crimp terminal 10 (10*a*) and of a part between the pressure-bonding section 30 and the aluminum core wire 201. Since the resistance of the aluminum core wire 201 was not ignorable, the resistance of the aluminum core wire 201 was subtracted from the measured resistance value, and the resultant value was set as the initial resistance between the crimp terminal 10 (10*a*) and the pressure-bonding section 30.

The corrosion test was performed as follows. The opposite end of the aluminum core wire 201 stripped of the insulating cover 202 was covered with a tube formed of PTFE and secured by a PTFE tape to be water-proof. Then, five male terminals and five female terminals were respectively inserted into the male connector housing 300 and the female connector housing 300. Both of the connector housings 300 were engaged with each other to prepare the joint connector 3.

This connector 3 was tested by the cosmetic corrosion test method for automotive parts defined by JASO M610-92. In more detail, the test was performed as follows. The connector 3 was left at a high temperature of 120° C. for 30 minutes, then exposed to spray of 5% salt water of 25° C. for 2 hours, then dried at 60° C. at a humidity of 30% RH for 4 hours, and then left at 50° C. at a humidity of 95% for 2 hours. This cycle was performed 30 times. After the test, a water-proof member was removed, and the resistance was measured in substantially the same manner as for the initial resistance. The initial resistance value was subtracted from the measured value regarding each sample. Thus, the resistance increasing value between the pressure-bonding section 30 and the aluminum core wire 201 after the exposure test was calculated.

When all of the 20 samples had a resistance increasing value of less than 1 mΩ, the terminal was evaluated as "◎". When three or less of the 20 samples had a resistance increasing value of 1 mΩ or more and less than 3 mΩ and the remaining samples had a resistance increasing value of less than 1 mΩ, the terminal was evaluated as "○". When more than three of the samples had a resistance increasing value of 1 mΩ or more and less than 3 mΩ and the remaining sample (s) had a resistance increasing value of less than 1 mΩ, the terminal was evaluated as "Δ". When at least one of the 20 samples had a resistance increasing value of 3 mΩ or more and less than 10 mΩ, the terminal was evaluated as "∇". When at least one of the 20 samples had a resistance increasing value of 10 mΩ or more, the terminal was evaluated as "X".

In addition, the degree of corrosion was observed at the cross-section. In more detail, the terminal was cut to have a round cross-section at the center or the vicinity of the pressure-bonded aluminum core wire 201, and the cross-section was polished. The polished cross-section was observed by an optical microscope and evaluated. When the aluminum core wire 201 was completely left in all the observed samples, the terminal was evaluated as "○". When the aluminum core wire 201 was partially lost due to corrosion in at least one of the observed samples, the terminal was evaluated as "Δ". When the aluminum core wire 201 was mostly or almost entirely lost due to corrosion in at least one of the observed samples, the terminal was evaluated as "X". The results are shown in Table 1.

TABLE 1

| No. | Rear with direction seal (41b) | Longitudinal direction seal (42, 43) | Front width direction seal (41a) | Resistance | Corrosion | External appearance |
|---|---|---|---|---|---|---|
| Example 1 | Butyl rubber 0.3 mmt | Epoxy-based UV-curable resin 0.03 mmt | Epoxy-based UV-curable resin 0.08 mmt | ◎ | ○ | |
| Example 2 | Silicone rubber 0.3 mmt | | | ◎ | ○ | |
| Comparative example 1 | Urethane rubber 0.3 mmt | | | x | x | |
| Comparative example 2 | Epoxy-based UV-curable resin 0.2 mmt | | | ∇ | x | |
| Comparative example 3 | Butyl rubber 0.3 mmt | Urethane-based UV-curable resin 0.03 mmt | Epoxy-based UV-curable resin 0.08 mmt | ∇ | x | |
| Comparative example 4 | | Butyl rubber 0.1 mmt | | ∇ | x | Rubber swollen out |
| Comparative example 5 | Butyl rubber 0.3 mmt | Epoxy-based UV-curable resin 0.03 mmt | Urethane-based UV-curable resin 0.03 mmt | ∇ | x | |
| Comparative example 6 | | | Butyl rubber 0.1 mmt | ∇ | x | Rubber swollen out |
| Comparative example 7 | Butyl rubber 0.05 mmt | Epoxy-based UV-curable resin 0.02 mmt | Epoxy-based UV-curable resin 0.05 mmt | ∇ | x | |

TABLE 1-continued

| No. | Rear with direction seal (41b) | Longitudinal direction seal (42, 43) | Front width direction seal (41a) | Resistance | Corrosion | External appearance |
|---|---|---|---|---|---|---|
| Example 3 | Butyl rubber 0.1 mmt | | | ◎ | Δ | |
| Example 4 | Butyl rubber 0.2 mmt | | | ◎ | ○ | |
| Example 5 | Butyl rubber 0.5 mmt | | | ◎ | ○ | |
| Comparative example 8 | Butyl rubber 1.0 mmt | | | ◎ | ○ | Rubber swollen out |
| Comparative example 9 | Butyl rubber 0.2 mmt | Epoxy-based UV-curable resin 0.005 mmt | Epoxy-based UV-curable resin 0.05 mmt | ∇ | x | |
| Example 6 | | Epoxy-based UV-curable resin 0.01 mmt | | ◎ | ○ | |
| Example 7 | | Epoxy-based UV-curable resin 0.05 mmt | | ◎ | ○ | |
| Comparative example 10 | | Epoxy-based UV-curable resin 0.1 mmt | | ◎ | ○ | Resin swollen out |
| Comparative example 11 | Butyl rubber 0.2 mmt | Epoxy-based UV-curable resin 0.02 mmt | Epoxy-based UV-curable resin 0.01 mmt | ∇ | x | |
| Example 8 | | | Epoxy-based UV-curable resin 0.02 mmt | ◎ | ○ | |
| Example 9 | | | Epoxy-based UV-curable resin 0.05 mmt | ◎ | ○ | |
| Comparative example 12 | | | Epoxy-based UV-curable resin 0.1 mmt | ◎ | ○ | Resin swollen out |

As can be seen from the table, in the case where the front width direction seal 41*a* was formed of an epoxy-based UV-curable resin having a thickness of 0.08 mm and the longitudinal direction seals 42 and the side end surface seals 43 were formed of an epoxy-based UV-curable resin having a thickness of 0.03 mm, when the rear width direction seal 41*b* was formed of butyl rubber having a thickness of 0.3 mm (Example 1) or silicone rubber having a thickness of 0.3 mm (Example 2), good results were obtained for both of the resistance and the corrosion. By contrast, when the rear width direction seal 41*b* was formed of urethane rubber having a thickness of 0.3 mm (Comparative example 1) or an epoxy-based UV-curable resin having a thickness of 0.2 mm (Comparative example 2), good results were not obtained for the resistance or the corrosion.

A conceivable reason is as follows. Among the materials used to form the rear width direction seal 41*b*, the epoxy-based UV-curable resin was harder than butyl rubber or silicone rubber. Therefore, at the time of pressure-bonding, the rear width direction seal 41*b* formed of the epoxy-based UV-curable resin excessively pressed a certain area of the electric wire to break the cover of the electric wire, and moisture invaded the electric wire from this area and corroded the electric wire. When urethane rubber was used, it is considered that urethane rubber was not resistant against a reaction product inside the connector (e.g., alkaline substance) and was deteriorated to cause moisture to invade.

In the case where the longitudinal direction seals 42 and the side end surface seals 43 were formed of a urethane-based UV-curable resin having a thickness of 0.03 mm (Comparative example 3) or butyl rubber having a thickness of 0.1 mm (Comparative example 4) unlike in Example 1 in which a sufficient moisture stop effect was provided, good results were not obtained. A conceivable reason is that the urethane-based UV-curable resin having a thickness of 0.03 mm was not resistant against a reaction product inside the connector (e.g., alkaline substance) and was deteriorated, and as a result, the sufficient moisture stop effect was not provided. In Comparative example 4, in which butyl rubber was used, butyl rubber was not hard and thus the sufficient moisture stop effect was not provided. Moreover, butyl rubber was swollen out when pressure-bonding was performed by the barrel pieces 32.

In the case where the front width direction seal 41*a* was formed of a urethane-based UV-curable resin having a thickness of 0.03 mm (Comparative example 5) or butyl rubber having a thickness of 0.1 mm (Comparative example 6) unlike in Example 1 in which a sufficient moisture stop effect was provided, good results were not obtained. A conceivable reason is that, again, the urethane-based UV-curable resin having a thickness of 0.03 mm was not resistant against a reaction product inside the connector (e.g., alkaline substance) and was deteriorated, and as a result, the sufficient moisture stop effect was not provided. In Comparative example 6, in which butyl rubber was used, butyl rubber was not hard and thus the sufficient moisture stop effect was not provided. Moreover, butyl rubber was swollen out when pressure-bonding was performed by the barrel pieces 32.

In the case where the rear width direction seal 41*b* was formed of butyl rubber having a thickness of 0.05 mm (Comparative example 7) or butyl rubber having a thickness of 1.0 mm (Comparative example 8) unlike in Example 1 in which a sufficient moisture stop effect was provided, good results were not obtained. In more detail, in the case where the rear width direction seal 41*b* was formed of butyl rubber having a thickness of 0.05 mm (Comparative example 7), the rear width direction seal 41*b* was too thin to provide the sufficient moisture stop effect. By contrast, in the case where the rear width direction seal 41*b* was formed of butyl rubber having a thickness of 1.0 mm (Comparative example 8), the sufficient moisture stop effect was provided, but the rear width direction seal 41*b* was too thick and butyl rubber was swollen out when pressure-bonding was performed by the barrel pieces 32. In the case where the rear width direction seal 41*b* was formed of butyl rubber having a thickness of 0.1 mm, 0.2 mm and 0.5 mm (Examples 3, 4 and 5), the sufficient moisture stop effect was provided.

In the case where the longitudinal direction seals 42 and 43 were formed of an epoxy-based UV-curable resin having a thickness of 0.005 mm, 0.01 mm, 0.05 mm and 0.1 mm (Comparative example 9, Example 6, Example 7, and Comparative example 10) unlike in Example 4 in which a sufficient moisture stop effect was provided, the results were as follows. In the case where the thickness was 0.005 mm (Comparative example 9), the longitudinal direction seals 42 and 43 were too thin to provide the sufficient moisture stop effect. By contrast, in the other cases, the sufficient moisture stop effect was confirmed. However, in the case where the thickness was 0.1 mm (Comparative example 10), the longitudinal direction seals 42 and 43 were too thick and the resin was swollen out when pressure-bonding was performed by the barrel pieces 32.

In the case where the front width direction seal 42*a* was formed of an epoxy-based UV-curable resin having a thickness of 0.01 mm, 0.02 mm, 0.05 mm and 0.1 mm (Comparative example 11, Example 8, Example 9, and Comparative example 12) unlike in Example 4 in which a sufficient moisture stop effect was provided, the results were as follows. In the case where the thickness was 0.01 mm (Comparative example 11), the front width direction seal 42*a* was were too thin to provide the sufficient moisture stop effect. By contrast, in the other cases, the sufficient moisture stop effect was confirmed. However, in the case where the thickness was 0.1 mm (Comparative example 12), the front width direction seal 42*a* was too thick and the resin was swollen out when pressure-bonding was performed by the barrel pieces 32.

As described above, it was confirmed that when the front width direction seal 41*a*, the rear width direction seal 41*b*, the longitudinal direction seals 42 and the side end surface seals 43 provided on the crimp terminal 10 (10*a*) are formed of an appropriate material and has an appropriate thickness in accordance with the positions thereof, the moisture stop property can be provided with certainty. It was also confirmed that owing to such a moisture stop property, the pressure-bonding connection structural body 1 (1*a*) and the connector 3 which are not decreased in the conductivity can be formed.

The electric wire conductor and the aluminum wire conductor according to the present invention correspond to the aluminum core wire 201 in the embodiment; and similarly, the cover corresponds to the insulating cover 202;

the tip of the cover corresponds to the cover tip 202*a;* the predetermined length corresponds to exposure length Xw;

the exposed part of the electric wire conductor corresponds to the electric wire exposed part 201*a;* the barrel piece corresponds to the barrel piece 32, the left barrel piece 32*a* or the right barrel piece 32*b;* the crimp terminal corresponds to the female crimp terminal 10, 10*a;* the length in the longitudinal direction corresponds to the length Xb in the longitudinal direction;

the moisture stop member corresponds to the width direction seals 41, the front width direction seal 41*a* (first moisture stop member), the rear width direction seal 41*b* (second moisture stop member), the longitudinal direction seals 42, the inner longitudinal direction seal 42*a* (first moisture stop member), the outer longitudinal direction seal 42*b*, or the side end surface seal 43;

the overlap part corresponds to the overlap part D;

the width direction end surface corresponds to the side end surface 34;

the connection structural body corresponds to the pressure-bonding connection structural body 1; and and the connector corresponds to the connectors 3, the male connector 3*a* or the female connector 3*b*.

However, the present invention is not limited to the above-described embodiment, and may be carried out in various other embodiments.

Figure 8A:
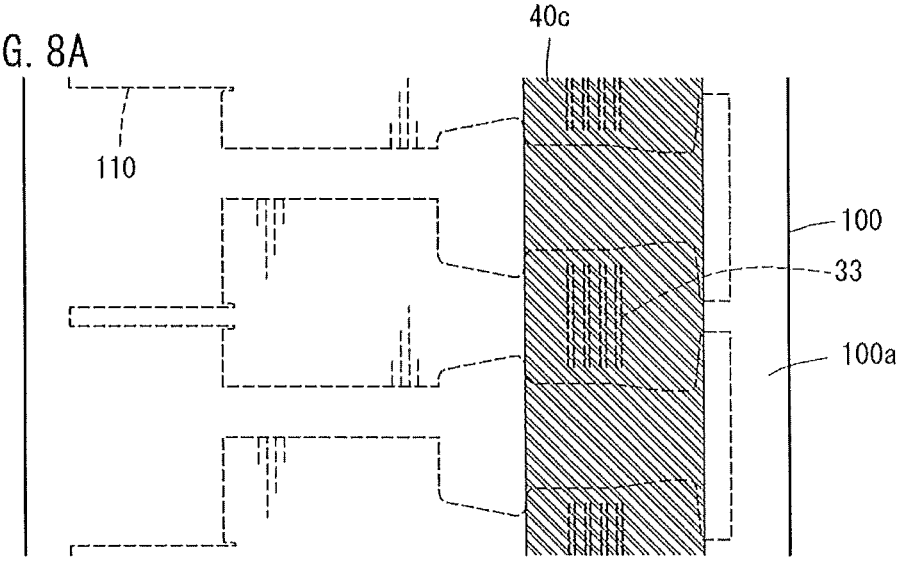
FIG. 8 illustrates a crimp terminal in another pattern.
Figure 8B:
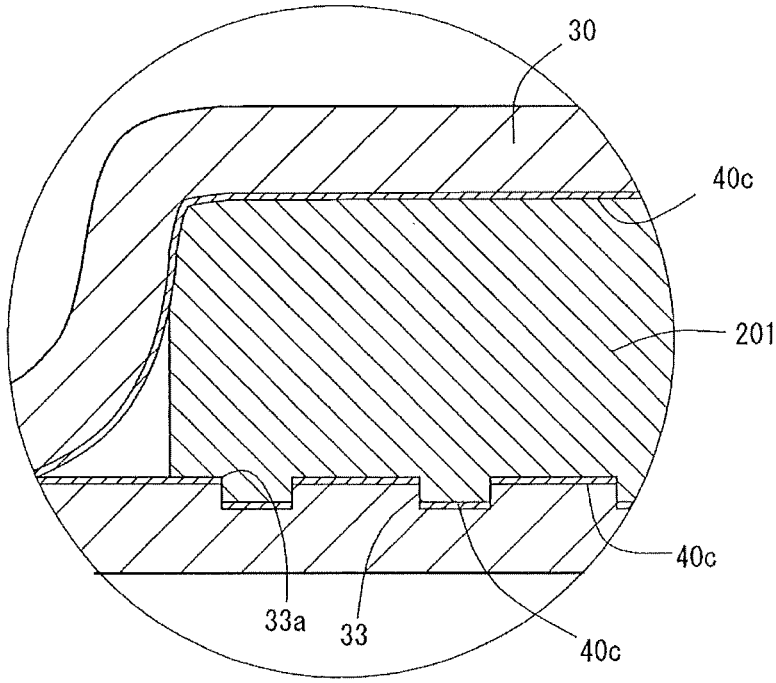
Figure 9:
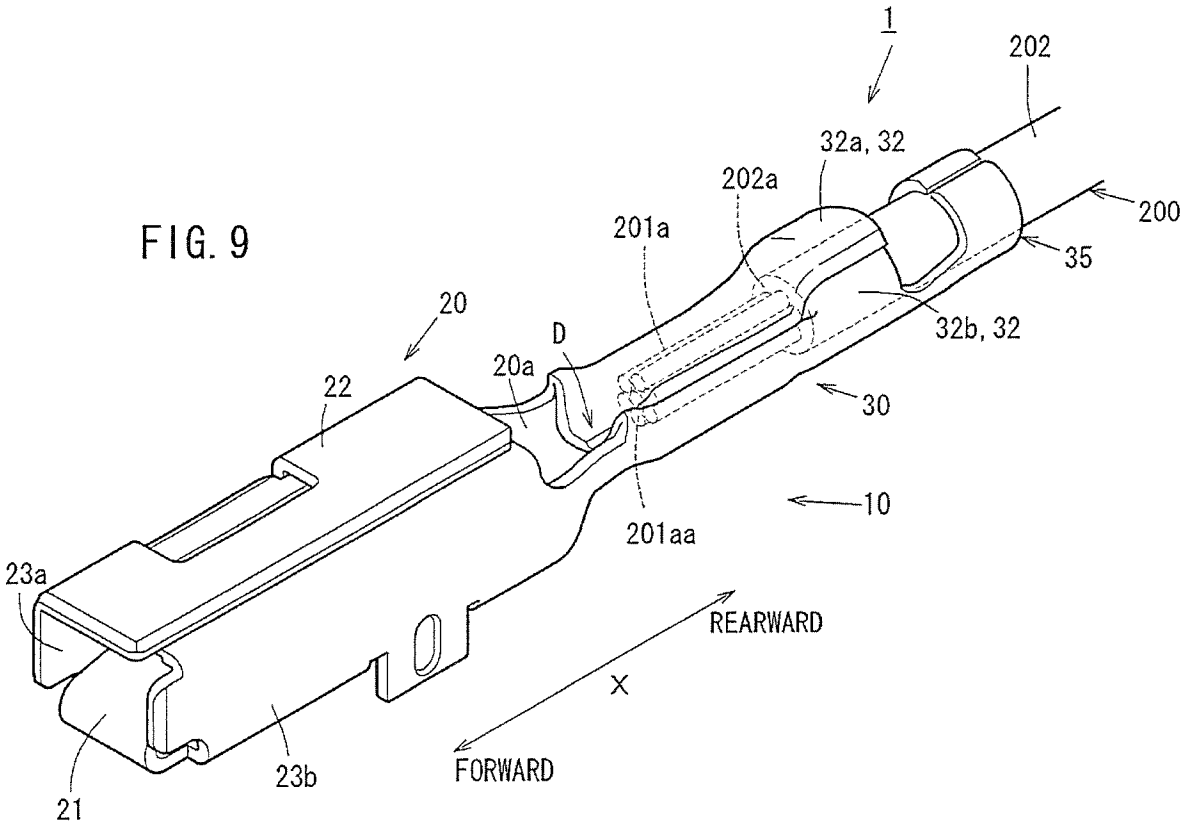
FIG. 9 illustrates a crimp terminal in still another pattern.

For example, in the state where the aluminum core wire 201 is pressure-bonded on the inner surface of the electric wire pressure-bonding range 30*a* of the pressure-bonding section 30, a plurality of serrations 33, which are grooves extending in the width direction Y into which the aluminum core wires 201 eats, may be formed in parallel in the longitudinal direction X, and thin-film curable moisture stop seals 40*c* formed of a curable resin may be formed so as to stride over the serrations 33. In more detail, as shown in FIG. 8(*a*), on a front surface 100*a* of the reflow tin-plated copper alloy strip 100, which is to form the inner surface of the female crimp terminal 10, the thin-film curable moisture stop seals 40*c* are provided in a belt form so as to stride over the serrations 33. The thin-film curable moisture stop seals 40*c* are formed in a thickness sufficient to provide the moisture stop property and the insulation property with certainty.

After the thin-film curable moisture stop seals 40*c* formed on the inner surface of the pressure-bonding section 30 in this manner are cured, the female crimp terminal 10 is formed and the aluminum core wire 201 of the insulated wire 200 is pressure-bonded by the barrel pieces 32. As a result, as shown in FIG. 8(*b*), which is a partial enlarged cross-sectional view of the pressure-bonding section 30 in a pressure-bonding state, the thin-film curable water stop seals 40*c* is present in a cured state between the aluminum core wire 201 and the inner surface of the pressure-bonding section 30. Therefore, the moisture stop property of the pressure-bonding section 30 can be improved.

However, since the thin-film curable water stop seals 40*c* cover the inner surface of the pressure-bonding section 30 in the form of thin films, it is difficult to provide conductivity between the pressure-bonding section 30 and the aluminum core wire 201 with certainty. Nonetheless, the conductivity can be provided with certainty for the following reason. The thin-film curable water stop seals 40*c* cover the inner surface of the pressure-bonding section 30 while striding over the serrations 33 and are cured in the form of thin films. Therefore, the thin-film curable water stop seals 40*c* on inner side surfaces of the serrations 33 are delaminated by the pressure-bonding pressure applied by the barrel pieces 32 of the pressure-bonding section 30 on the aluminum core wire 201. In addition, an oxide coat of the aluminum core wire 201 is removed by being slid against edges 33*a* of the serrations 33. As a result, metal coupling occurs between the aluminum core wire 201 and the surface of the female crimp terminal 10. For this reason, the conductivity can be provided with certainty.

Accordingly, galvanic corrosion, which is caused by moisture attaching a contact part of the aluminum core wire 201 formed of aluminum, which has a lower potential than that of the copper alloy strip 100 used to form the female crimp terminal 10, and the female crimp terminal 10, can be prevented.

In the above description, the serrations 33 are grooves extending in the width direction. Alternatively, the serrations may be in a lattice or a houndstooth check. Still alternatively, the serrations may be convex portions instead of concave portions.

Rear to the pressure-bonding section 30 in the longitudinal direction X, an insulation barrel 35 (corresponding to the cover pressure-bonding section) for pressure-bonding an outer surface of the insulating cover 202 of the insulated wire 200 may be coupled.

In this case, even if an external force such as a bending force or the like acts on the insulated wire 200, moisture stop performance can be provided with certainty. For example, when a load caused by an external force such as a bending or tensile force having a large vibration width acts on the insulated wire 200 excessively, the stress thereof acts on the rear end of the pressure-bonding section 30 in a concentrated manner. As a result, a gap may be formed between the inner surface of the cover pressure-bonding range 30*b* and the surface of the insulating cover 202. In such a case, the moisture stop property of the pressure-bonding section 30 may be lowered.

However, in the case where the insulation barrel 35 is provided rear to the pressure-bonding section 30 in the longitudinal direction X, the load caused by an external force acts on the insulation barrel 35. Therefore, no gap is formed between the inner surface of the cover pressure-bonding range 30*b* and the surface of the insulating cover 202. Thus, perfect moisture stop is realized. Accordingly, galvanic corrosion, which is caused by moisture attaching a contact part of the aluminum core wire 201 formed of aluminum, which has a lower potential than that of the copper alloy strip 100 used to form the female crimp terminal 10, and the female crimp terminal 10, can be prevented.

The insulation barrel 35 may be included in the female crimp terminal 10*a* in the second pattern.

REFERENCE SIGNS LIST

1, 1*a* . . . Pressure-bonding connection structural body
3 . . . Connector
3*a* Female connector
3*b* Male connector
10, 10*a* . . . Female crimp terminal
30 . . . Pressure-bonding section
32 . . . Barrel piece
32*a* . . . Left barrel piece
32*b* . . . Right barrel piece
34 . . . Side end surface
35 . . . Insulation barrel
40*c* . . . Thin-film curable moisture stop seal
41 . . . Width direction seal
41*a* . . . Front width direction seal
41*b* . . . Rear width direction seal
42 . . . Longitudinal direction seal
42*a* . . . Inner longitudinal direction seal
42*b* . . . Outer longitudinal direction seal
43 . . . Side end surface seal
201 . . . Aluminum core wire
201*a* . . . Electric wire exposed part
202 . . . Insulating cover
202*a* . . . Cover tip
300 . . . Connector housing
D . . . Overlap part
Xw . . . Exposure length
X . . . Longitudinal direction
Xb . . . Length in the longitudinal direction
Y . . . Width direction

The invention claimed is:

1. A crimp terminal, comprising barrel pieces respectively on both of two sides in a width direction thereof, the barrel pieces being included in a pressure-bonding section for pressure-bonding an exposed part of an electric wire conductor of an insulated wire, wherein the insulated wire includes the electric wire conductor and an insulating cover for covering an outer circumference of the electric wire conductor, and the exposed part is a part of the electric wire conductor which is exposed from a tip of the cover by a predetermined length; wherein:

the barrel pieces each have a length in a longitudinal direction which is longer than the length of the exposed part of the electric wire conductor;

a first moisture member is attached on a part of an inner surface of the pressure-bonding section at outer edges of the pressure-bonding section;

a second moisture member is attached on a part of an outer surface of the pressure-bonding section at an outer edge of the pressure-bonding section;

the pressure-bonding section pressure-bonds, by the barrel pieces, a continuous part from a tip of the electric wire conductor to a position rear to the tip of the cover such that the continuous part is integrated by the barrel pieces;

the first and second moisture members are formed of a resin or a rubber;

the first moisture stop member has a belt-like shape that extends along a latitudinal direction of the barrel piece and the longitudinal direction of the barrel piece; and the second stop member has a belt-like shape that extends along a longitudinal direction of the barrel piece.

2. A crimp terminal according to claim 1, wherein in the pressure-bonding section in a pressure-bonding state, end surfaces, in the width direction, of the barrel pieces are joined together in a face-to-face manner.

3. A crimp terminal according to claim 1, wherein in the pressure-bonding section in a pressure-bonding state, an end of one of the barrel pieces overlaps an outer surface of an end of the other barrel piece, so that an overlap part extending in the longitudinal direction is formed.

4. A crimp terminal according to claim 2, wherein the moisture stop members are provided on the end surface, in the width direction, of at least one of the barrel pieces.

5. A crimp terminal according to claim 1, further comprising a serration formed in an inner surface of the pressure-bonding section;

wherein the moisture stop members are formed of a curable resin, so that the cured resin covers the serration in the form of a thin film so as to stride over the serration.

6. A crimp terminal according to any one of claims 1, 3, and 2-5, wherein a cover pressure-bonding section for pressure-bonding the cover of the insulated wire is coupled to the pressure-bonding section.

7. A connection structural body, comprising the insulated wire and the crimp terminal according to claim 6, wherein the insulated wire and the crimp are electrically connected with one another.

8. A connection structural body according to claim 7, wherein the insulated wire is connected such that the electric wire conductor is entirely accommodated in the pressure-bonding section, such that the electric wire does not extend out of the pressure-bonding section.

9. A connection structural body according to claim 7, wherein the electric wire conductor of the insulated wire is formed of an aluminum wire conductor.

10. A connector, comprising the crimp terminal in the connection structural body according to claim 7 located in a connector housing.

* * * * *